US007185743B2

(12) United States Patent
Fischer

(10) Patent No.: US 7,185,743 B2
(45) Date of Patent: Mar. 6, 2007

(54) DRIVE FOR AN ELEVATOR INSTALLATION

(75) Inventor: Daniel Fischer, Ollon (CH)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 11/146,963

(22) Filed: Jun. 7, 2005

(65) Prior Publication Data

US 2006/0169541 A1 Aug. 3, 2006

(30) Foreign Application Priority Data

Jun. 19, 2004 (EP) ..... 04014440

(51) Int. Cl.
*B66B 11/08* (2006.01)

(52) U.S. Cl. ..... 187/254; 187/254; 310/59; 310/62

(58) Field of Classification Search ..... 187/291, 187/254; 310/58, 62; 384/321; 254/331
See application file for complete search history.

(56) References Cited

U.S. PATENT DOCUMENTS

| | | | | |
|---|---|---|---|---|
| 2,607,637 A | | 8/1952 | Mercier | |
| 4,153,851 A | * | 5/1979 | Hovorka | 310/23 |
| 4,172,985 A | * | 10/1979 | Meier | 310/74 |
| 4,493,399 A | * | 1/1985 | Kajiyama | 187/291 |
| 6,520,299 B2 | * | 2/2003 | Rimann et al. | 188/171 |
| 6,630,757 B2 | * | 10/2003 | Nakamura et al. | 310/62 |
| 6,707,204 B2 | * | 3/2004 | Odachi et al. | 310/102 R |
| 2001/0048253 A1 | | 12/2001 | Nakanura et al. | |
| 2004/0108170 A1 | * | 6/2004 | Kocher et al. | 187/254 |

FOREIGN PATENT DOCUMENTS

| | | |
|---|---|---|
| DE | 42 22 094 | 11/1993 |
| DE | 43 23 361 | 1/1995 |
| DE | 44 05 593 | 7/1995 |
| EP | 0 631 969 | 1/1995 |
| EP | 1 400 477 | 3/2004 |

* cited by examiner

*Primary Examiner*—Gene O. Crawford
*Assistant Examiner*—Terrell Matthews
(74) *Attorney, Agent, or Firm*—Butzel Long

(57) ABSTRACT

A drive for an elevator installation which drives a car and a counterweight with a supporting and driving belt includes a drive shaft and at least one drive pulley driven in rotation by a motor. An air guide element is arranged in the region between the motor and the drive pulley and guides air from the region of the supporting and driving belt along the drive shaft and through the motor.

12 Claims, 3 Drawing Sheets

DRIVE FOR AN ELEVATOR INSTALLATION

BACKGROUND OF THE INVENTION

The present invention relates to a drive for an elevator installation.

An elevator installation consists of a car for reception of goods or persons to be transported and a counterweight, or a second car, which are connected together by way of supporting and driving means via a drive. The drive of the elevator installation in that case has the object of driving the driving and supporting means and thus an alternate raising and lowering of the car and the counterweight.

The drive consists of the principal components of a drive pulley, a motor and a brake. The drive pulley receives the supporting and driving means and transmits drive forces to the supporting and driving means by way of a mechanically positive or friction couple. The motor for its part drives the drive pulley, and the brake brakes the drive pulley.

A drive for an elevator is shown in the European patent document EP 1 400 477 in which a motor drives drive pulleys by means of a drive shaft and the drive pulleys are braked by a brake. The drive pulleys are in that case, in a preferred form of embodiment, arranged between the motor and the brake unit. The drive pulleys drive flat belts. This allows use of small drive pulley diameters. The drive can thereby be of small and compact construction.

However, the illustrated drive has disadvantages:

I. A conventional motor such as, for example, an asynchronous motor generates heat which has to be conducted away at least partly via the drive shaft. The drive pulleys thereby significantly heat up and this impairs the service life expectation of conventional supporting or flat belts.

II. The mounting and, in particular, the alignment of the drive pulley axle relative to the running direction of the supporting and driving means is costly.

SUMMARY OF THE INVENTION

An object of the present invention is to provide an elevator drive for an elevator installation which eliminates the mentioned disadvantages. It shall in particular have small external dimensions and keep the heat development in regions of the drive pulleys low.

The present invention relates to a drive for an elevator installation which drives a car and a counterweight by way of supporting and driving means, and the drive comprises a drive pulley which is driven by a motor via a drive shaft and is braked by a brake, wherein the drive shaft, the motor and the brake are combined into a unit.

According to the present invention an air guide element which guides cool air from the region of the supporting and driving means or the drive pulley along the drive shaft is arranged in the region between drive pulley and motor. The flow of cool air is advantageously produced by a fan. Cool air from the region of the supporting and drive means or from the region of the drive pulley is thereby guided to the drive shaft and the adjoining motor, which on the one hand prevents penetration of heated motor air into the zone of the supporting and driving means and at the same time effectively cools the drive shaft. The air guide element increases the cooling effect in that the air flow is conducted onto the drive shaft region and in that the region of the supporting and driving means is screened from hot parts of the motor. The supporting and driving means can thereby be operated at lower temperatures, which has an advantageous effect on the service life thereof. In addition, a drive with smaller dimensions can be constructed, since motor and drive pulley can be arranged closely adjacent to one another.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
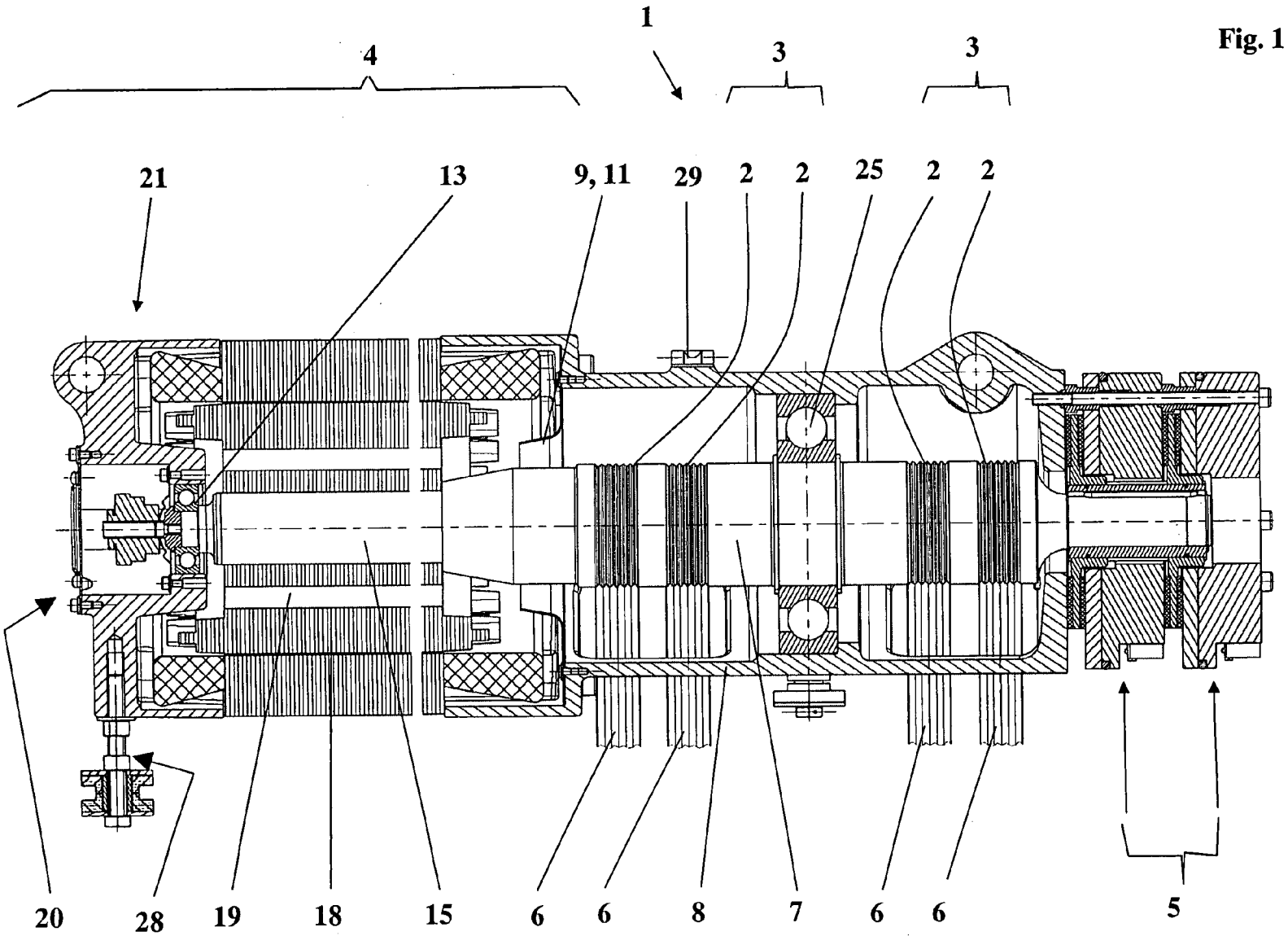
FIG. 1 is a cross-sectional view of a drive constructed in accordance with the present invention.

FIG. 1 shows a drive 1 for an elevator installation with the main characteristics of the present invention. The drive 1 consists of one or more drive pulley zones 3 that each have at least one drive pulley 2. The drive pulley 2 serves for reception of a supporting and driving means 6 which connects a car of the elevator installation with a counterweight or a second car. The drive pulley 2 is, in the case of the illustrated drive 1, integrated in a drive shaft 7. A motor 4 driving the drive shaft 7 is arranged in an adjoining manner at the drive pulley 2.

Figure 2:
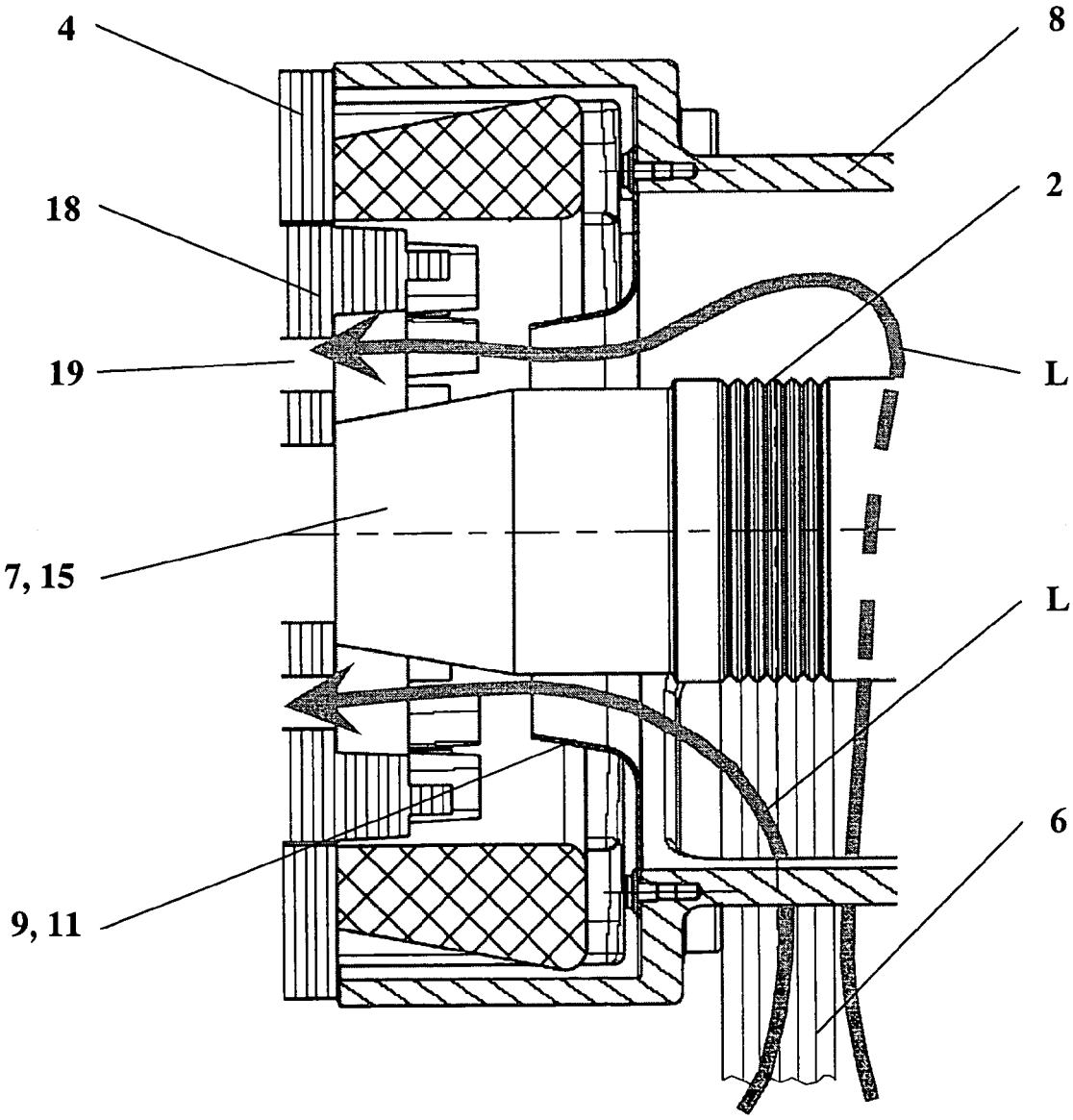
FIG. 2 is an enlarged view of the air guide plate incorporated in the drive shown in FIG. 1.

An air guide element 11 which guides cool air L from the region of the supporting and driving means 6 along the drive shaft 7 is arranged in the region between the motor 4 and the drive pulley 2, as illustrated in detail in FIG. 2.

Through the arrangement of the air guide element 1 the region of the drive shaft 7, which contains the drive pulley 2, is screened from the hot parts of the motor 4 and at the same time the drive shaft 7 is cooled in the critical region by the cool air flow L guided along the drive shaft 7. The heat loading which the supporting and drive means 6 has to bear is thereby reduced.

Advantageously, the air guide element 11 is an air guide plate 9. A plate is suitable for economic manufacture of a part of that kind, it being easily capable of shaping. A cooling effect is optimized by the special form of the air guide element 11. The air guide element 11 or the free air throughflow area continuously narrows, in the direction of the motor, to a minimum. This increases the speed of the air flow in this narrowest cross-section. This produces an optimum cooling of the drive shaft 7 in this region.

In the mentioned example the air guide element 11 is detachably fastened to a support 8. The support 8 forms a carrying structure of the drive 1 at which, depending on the respective mode of construction, parts of the drive 1 are arranged. It also enables, for example, fastening of the drive 1 in the building. The support 8 can in that case be an integrated component of the motor 4 or a brake 5 or it can be a housing which receives bearing points of the drive 1 or encloses the drive pulleys 2. Fastening of the air guide element 11 to the support 8 enables simple mounting and correspondingly economic manufacture.

Other embodiments of the air guide element 11 are possible. It can be made of a heat-resistant plastic material or other materials, it can be made by means of a casting process or it can be directly constructed as part of the motor 4, the support 8 or another part of the drive 1.

In an advantageous embodiment a rotor 18 of the motor 4 is, as apparent in FIG. 1, provided with longitudinal openings 19 which enable a throughflow of the air L, and the drive 1 is provided with a fan 20 which forcibly inducts the air L from the space of the drive pulley 2 and conducts it away through the longitudinal openings 19 in the rotor 18 of the motor 4 via a motor end 21. In the illustrated example the fan is arranged at the end of the motor 4. This embodiment enhances the cooling effect of the air guide plate 9 and effectively dissipates the heat of the motor 4.

Other arrangements of the fan 20 are possible. It can be integrated in a part of the drive 1, as for example the motor 4 or the support 8, or it can also be attached, as an individual ventilating unit, to the drive 1.

Figure 3:
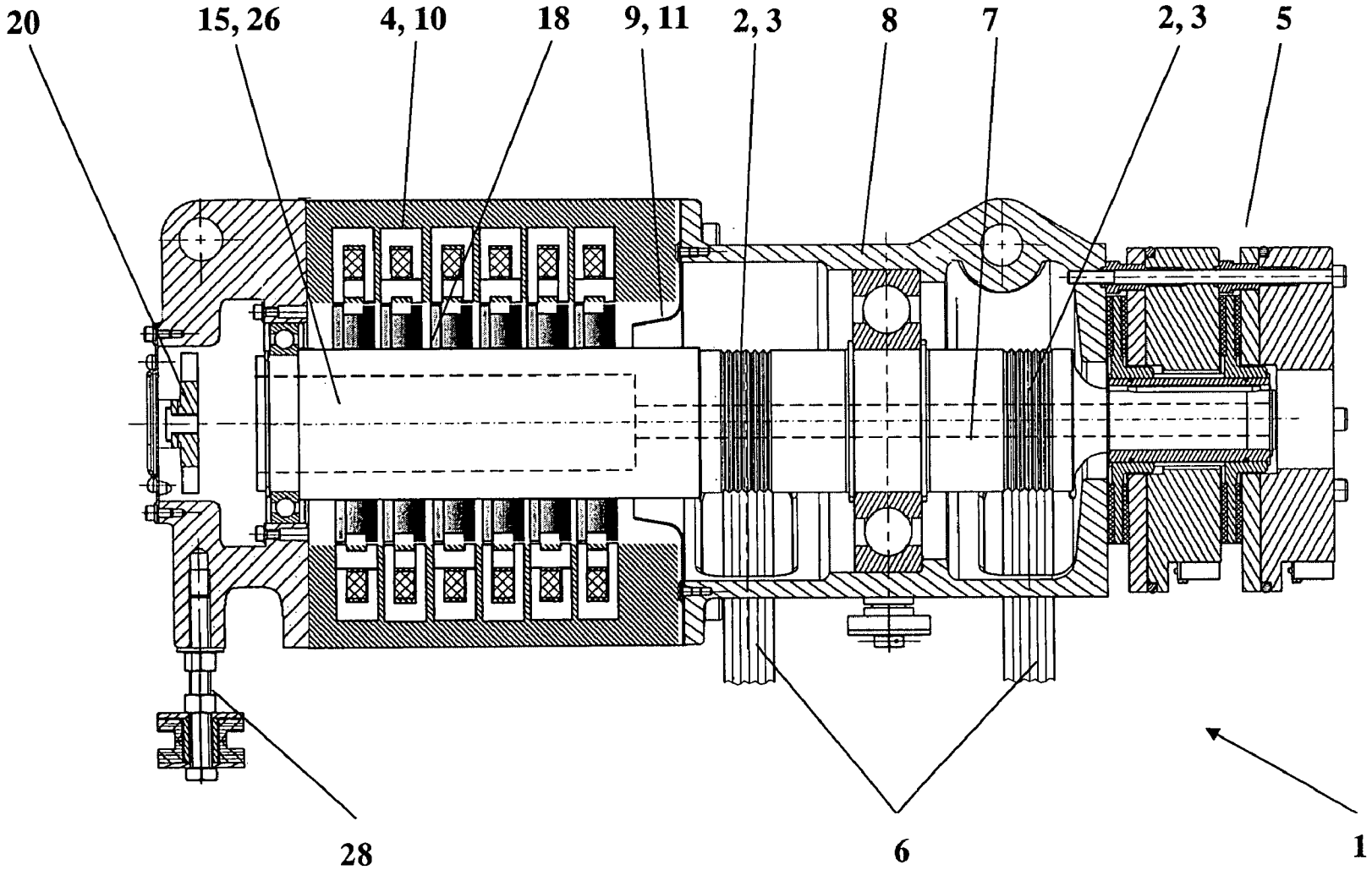
FIG. 3 is cross-sectional view of a drive according to the present invention with a transverse flux motor.

As illustrated in FIGS. 1 and 3, the drive 1 in a preferred embodiment consists of two mutually spaced-apart drive zones 3, wherein the drive zone 3 can contain one or more of the drive pulleys 2. The motor 4 and/or the brake 5 is or are arranged outside the two drive zones 3 and a main bearing 25 is arranged between the two drive zones 3, so that a main supporting force of the carrying force, which is produced by the supporting and driving belts 6, is substantially introduced into a supporting structure by means of the main bearing 25.

A direct and optimum introduction of the supporting forces of the drive 1 into a supporting structure is thus made possible. The drive can thereby be of compact construction and realized economically.

The use of flat belts as the supporting and driving means 6 is particularly advantageous. Flat belts 6 allow use of small drive pulley diameters. A drive 1 with correspondingly high rotational speeds and low torques can thereby be used, which in turn permits use of drives with small dimensions. The flat belts in that case are, in correspondence with the construction of the traction surface of the drive pulley 2, flat, i.e. smooth, or they have a longitudinal profiling, for example in the form of wedge ribs, or they have a transverse profile, for example a tooth shape.

In the illustrated examples of FIG. 1 and FIG. 3, a motor shaft 15, the drive shaft 7 and the drive pulley 2 are of integral construction. Alternatively, merely the motor shaft 15 and the drive shaft 7 can be of integral construction, or the drive shaft 7 and the drive pulley 2 are made from one piece. Production as individual separate parts is obviously also possible. Selection of the suitable form of embodiment is carried out according to the choice of the manufacturer.

An advantageous embodiment of the drive arranges a level setting means 28 at the drive 1. The level setting means 28 accepts forces which arise due to asymmetrically introduced supporting means forces. Ideally this level setting means 28 is mounted in the vicinity of a support bearing 13. The drive 1 can be leveled in simple mode and manner by the settable level setting means 28. A spirit level 29 mounted in the housing of the drive 1 in that case facilitates checking of the setting. The arrangement of the support bearing 13 at the end, which is at the motor side of the drive shaft 7 or of the motor shaft 15, enables an optimum introduction of supporting forces into the building.

The drive 1 for an elevator installation with a further advantageous characteristic of the invention is illustrated in FIG. 3. The motor 4 of the drive 1 is constructed as a transverse flux motor 10, ideally with permanent excitation. The transverse flux motor 10 has lower internal losses. It accordingly generates less heat. In addition, a transverse flux motor 10 has very good torque courses, which are particularly suitable for use in elevator construction. In an advantageous refinement the motor shaft 15 is constructed in addition as a hollow shaft 26. In this example the fan 20 is similarly arranged at the end of the motor 4. The fan on the one hand sucks air through the optional hollow shaft 26 and on the other hand sucks air from the region of the drive pulley 2 via gaps and optional openings in the rotor 18 and conducts away the heated air via the end of the motor 4. The low heat development, which additionally reduces the heat action on the supporting and driving means 6, is advantageous in the case of this invention. Residual heat which arises can be led away through the hollow shaft 26 and by the air flow guided by means of the air guide element 11.

The illustrated forms of embodiment are examples. Thus, for example, the brake can also be arranged at the end of the drive shaft at the motor side.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A drive for an elevator installation which drives a car and a counterweight by way of a supporting and driving means comprising:

a drive shaft;

a drive pulley coupled to said drive shaft for engaging the supporting and driving means;

a motor coupled at one end to said drive shaft for rotating said drive pulley; and an air guide element positioned between said motor and said drive pulley for guiding air from a region of the supporting and driving means along said drive shaft toward said motor; wherein said air guide elements is an air guide plate formed with a free air throughflow area that continuously reduces toward the said motor to a minimum area and said air guide element is fastened to a support.

2. The drive according to claim 1 including a fan which inducts air from a space about said drive pulley and guides the air away via an end of the motor opposite said one end.

3. The drive according to claim 1 including a rotor of said motor being provided with longitudinal openings which enable a throughflow of the air.

4. The drive according claim 1 having at least two mutually spaced-apart drive zones each with at least one of said drive pulley, a main bearing arranged between said drive zones and at least one of said motor and a brake being arranged outside said two drive zones.

5. The drive according to claim 1 wherein the supporting and driving means is a belt and a traction surface of said drive pulley is one of flat, longitudinally profiled or transversely profiled.

6. The drive according to claim 1 wherein said motor has a motor shaft integral with said drive shaft.

7. The drive according to claim 6 wherein said drive shaft and said drive pulley are of integral construction.

8. The drive according to claim 1 wherein said drive shaft and said drive pulley are of integral construction.

9. The drive according to claim 1 including a support bearing arranged at an end of said motor side opposite said drive pulley.

10. The drive according to claim 1 including a level setting means mounted on the drive.

11. The drive according to claim 1 wherein said motor is a transverse flux motor having a hollow shaft through which the air is guided by said air guide element.

12. A drive for an elevator installation which drives a car and a counterweight by way of a supporting and driving means comprising:

a drive shaft;

at least two drive zones spaced along said drive shaft, each said drive zone having at least one drive pulley coupled to said drive shaft for engaging the supporting and driving means;

a motor coupled at one end to said drive shaft for rotating said drive pulleys; and an air guide element positioned between said motor and said drive zones for guiding air from a region of the supporting and driving means along said drive shaft toward said motor; wherein said air guide elements is an air guide plate formed with a free air throughflow area that continuously reduces toward the said motor to a minimum area and said air guide element is fastened to a support.

* * * * *